US009499944B2

(12) United States Patent
Reed et al.

(10) Patent No.: US 9,499,944 B2
(45) Date of Patent: Nov. 22, 2016

(54) WET STRENGTH TREATED PAPER AND PAPERBOARD

(71) Applicant: Georgia-Pacific Chemicals LLC, Atlanta, GA (US)

(72) Inventors: Gregg A. Reed, Conyers, GA (US); William J. Haskins, Acworth, GA (US); Lakeisha D. Talbert, Union City, GA (US)

(73) Assignee: Georgia-Pacific Chemicals LLC, Atlanta, GA (US)

( * ) Notice: Subject to any disclaimer, the term of this patent is extended or adjusted under 35 U.S.C. 154(b) by 129 days.

(21) Appl. No.: 14/326,515

(22) Filed: Jul. 9, 2014

(65) Prior Publication Data

US 2015/0020985 A1 Jan. 22, 2015

Related U.S. Application Data

(60) Provisional application No. 61/846,855, filed on Jul. 16, 2013.

(51) Int. Cl.

| | |
|---|---|
| ***D21H 21/20*** | (2006.01) |
| ***D21H 19/26*** | (2006.01) |
| ***D21H 19/30*** | (2006.01) |
| ***D21H 19/84*** | (2006.01) |
| ***D21H 23/22*** | (2006.01) |
| ***D21H 23/30*** | (2006.01) |
| *D21H 17/55* | (2006.01) |

(52) U.S. Cl.

CPC ..... *D21H 21/20* (2013.01); *D21H 5/0007* (2013.01); *D21H 19/26* (2013.01); *D21H 19/30* (2013.01); *D21H 19/84* (2013.01); *D21H 23/22* (2013.01); *D21H 23/30* (2013.01); *D21H 17/55* (2013.01)

(58) Field of Classification Search

CPC ..... D21H 21/18; D21H 21/20; D21H 23/22–23/40; D21H 19/10–19/30; D21H 19/82; D21H 19/84; D21H 17/455; D21H 17/51; D21H 17/56; D21H 5/0005; D21H 5/0007; D21H 5/0012; D21H 25/06; D21J 1/08

USPC ..... 162/135–137, 184, 187, 157.3, 157.5, 162/164.6, 166, 167, 168.2; 427/299, 315, 427/326, 444, 308; 118/73

See application file for complete search history.

(56) References Cited

U.S. PATENT DOCUMENTS

| | | | | |
|---|---|---|---|---|
| 1,989,036 | A * | 1/1935 | Bradner | D21H 5/0007 118/206 |
| 3,755,220 | A * | 8/1973 | Freimark | D21F 11/14 162/146 |
| 3,772,076 | A * | 11/1973 | Keim | C08F 8/00 162/164.3 |
| 6,187,142 | B1 * | 2/2001 | Heinzmann | D21H 23/46 118/257 |
| 6,537,616 | B2 * | 3/2003 | Gilfert | D21H 25/06 427/335 |
| 2010/0310883 | A1 * | 12/2010 | Brungardt | D21H 17/46 428/424.8 |

* cited by examiner

*Primary Examiner* — Eric Hug
(74) *Attorney, Agent, or Firm* — Ram W. Sabnis

(57) ABSTRACT

A process for improving the wet strength of paper or paperboard is disclosed, and compositions, methods, and products related to improved wet strength paper or paperboard are provided. The process includes, for example, contacting at least one side of the paper or paperboard with water or an aqueous composition to wet the paper or paperboard, contacting the wet paper or paperboard with a wet strength resin composition followed by drying the paper or paperboard. The resulted treated or coated paper or paperboard has comparable wet strength properties to that of paper or paperboard containing wet strength resin from a conventional wet end application.

20 Claims, No Drawings

WET STRENGTH TREATED PAPER AND PAPERBOARD

CROSS-REFERENCE TO RELATED APPLICATIONS

This application claims the benefit of priority to U.S. Provisional Application No. 61/846,855, filed Jul. 16, 2013, the disclosure of which is incorporated herein by reference in its entirety.

TECHNICAL FIELD

The invention relates to paper and paperboard having improved wet strength and processes and compositions for improving the wet strength of paper and paperboard.

BACKGROUND

Paper is sheet material containing interconnected small, discrete fibers. The fibers are usually formed into a sheet on a fine screen from a dilute water suspension or slurry. Paper typically is made from cellulose fibers, although occasionally synthetic fibers are used. Paper products made from untreated cellulose fibers lose their strength rapidly when they become wet, i.e., they have very little "wet strength". Wet strength of ordinary paper is only about 5% of its dry strength. The wet strength of paper is defined as the resistance of the paper to rupture or disintegration when it is wetted with water. See U.S. Pat. No. 5,585,456. To overcome this disadvantage, various methods of treating paper products have been employed.

Paperboard is a thick paper based material that is used extensively for packaging applications. Wet strength retention can be a particularly desirable characteristic in paperboard that is used in carton, container, and packaging because of the prolonged exposure to moisture these materials may experience in these roles. However, paperboard often has poor wet strength properties, and conventional processes to impart wet strength may require additional process steps and add unwanted expensive. Therefore, there is a continuing need in the art for processes and compositions for imparting appropriate levels of wet strength to paper products, including paper and particularly paperboard.

SUMMARY

The present disclosure provides new processes, compositions, and methods related to imparting wet strength to paper and paperboard. In some aspects, the processes, compositions, and methods are particularly useful for paperboard used in carton, container, and packaging applications. Generally, this disclosure provides methods by which appropriate levels of wet strength can be attained and the expense associated with additional processing steps can be reduced or minimized. According to an aspect of the disclosure, paper and paperboard treated according to the processes of this disclosure can have from 1.5 to 3.5 times greater wet mullen, or even more, as compared with the wet mullen of the paper and paperboard prior to treating. Generally, the processes, compositions, and methods related to imparting wet strength to paperboard throughout this disclosure apply to paper as well, and any disclosure of uses related to paperboard are intended to constitute corresponding disclosures of uses related to paper.

Specifically, it has been unexpectedly discovered that the wet strength (wet mullen) attained by the disclosed method approaches that attained in a conventional wet end application of wet strength compositions. According to one aspect, there is provided a process for improving the wet strength of paper or paperboard, comprising:

a) providing a paper or paperboard having a first side and a second side;

b) contacting at least one of the first side and the second side with water or an aqueous composition for a first time period to provide a wet paper or paperboard; and c) contacting the wet paper or paperboard with a wet strength resin composition for a second time period to provide a treated paper or paperboard.

Paper or paperboard that is treated in this manner generally is dried and deployed in any number of container and packaging applications. Moreover, any paper or paperboard can be subjected to this process improving wet strength, including paper or paperboard that is previously untreated and paper or paperboard that is previously subject to conventional wet strength treatment at the wet end.

Generally, the aqueous composition used in the first contacting or "pretreatment" step, the wet strength resin composition used in the second contacting step, or both compositions can comprise a surfactant. Further, steps b and c recited above can be carried out on the first side of the paper or paperboard, and subsequently repeated on the second side of the paper or paperboard, if desired, in which the compositions used in each of steps b and c can be the same or can be different. In some aspects, step(s) b can be carried out on the first side and second side of the paper or paperboard, either substantially simultaneously or sequentially, and subsequently step(s) c can be carried out on the first side and second side of the paper or paperboard, either substantially simultaneously or sequentially, if desired, with each composition being selected independently.

In an aspect, a wide range of surfactants can be used in accordance with this disclosure, including for example, a nonionic surfactant, an anionic surfactant, a cationic surfactant, or an amphoteric surfactant. These surfactants can be used in either the first, second, or both contacting steps disclosed above. Moreover, when more than one side of the paper or paperboard is contacted with water or an aqueous composition, surfactant may be used in one or more than one aqueous composition as desired.

Similarly, a wide range of wet strength resin compositions can be used according to this disclosure, including for example, compositions that are or that comprise an aliphatic aldehyde, an aromatic aldehyde, a urea-formaldehyde resin, a melamine formaldehyde resin, or a polyamide-epihalohydrin resin. For example, the wet strength resin composition can comprise an epihalohydrin-modified polyamine, polyamidoamine, polyethyleneimine (PEI), polyvinyl amine, or a combination thereof. Also by way of example, the polyamine used for the epihalohydrin-modified polyamine wet strength composition can be reacted with a mono-functional modifier prior to, during, or after treating with the epihalohydrin as provided herein. Examples of mono-functional modifiers include, for example, acrylate compounds, acrylamide compounds, acrylonitrile compounds, mono-epoxide compounds, and combinations thereof.

The disclosed process is versatile in that it is useful for improving the wet strength of paper or paperboard that is previously untreated with a wet strength resin at the process wet end and also useful for improving the wet strength of paper or paperboard that is previously treated with a wet strength resin at the process wet end. The present disclosure also provides for paper or paperboard that has improved wet strength and that is prepared according to the disclosed processes.

Applicants have unexpectedly discovered that the water or aqueous composition used in the first contacting or "pretreatment" step allows the wet strength resin composition to better contact with the cellulose fibers of the paper or paperboard as compared to the cellulose fibers of paper or paperboard that has not be pretreated in this fashion. Accordingly, this disclosure also provides for paper or paperboard having improved wet strength, the paper or paperboard comprising a treated fibrous web, in which the treated fibrous web can comprise:

a) cellulose fibers, a portion of which having intact inter-fiber hydrogen bonding and a portion of which having inter-fiber hydrogen bonding at least partially disrupted with water or an aqueous composition;
b) a wet strength resin composition in contact with the cellulose fibers having partially disrupted inter-fiber hydrogen bonding.

The aqueous composition used in preparing the paper or paperboard comprising a treated fibrous web, the wet strength resin composition used to contact the cellulose fibers having partially disrupted inter-fiber hydrogen bonding, or both compositions can comprise a surfactant.

Moreover, the surfactant used in either composition can be selected independently from, or can independently comprise, a nonionic surfactant, an anionic surfactant, a cationic surfactant, or an amphoteric surfactant.

These and other aspects, embodiments, and details of the disclosed processes, compositions, and methods are provide in the detailed description that follows.

DETAILED DESCRIPTION

This disclosure relates to paper, paperboard and linerboard having improved wet strength properties and further relates to processes and compositions for improving the wet strength of paper, paperboard and linerboard. In particular, a process has been developed to coat paper or paperboard with wet strength resin, in which the resulting coated paper or paperboard has comparable wet strength properties to that of paper or paperboard containing wet strength resin from a traditional wet end application.

According to an aspect of this disclosure, there is provided a process for improving the wet strength of paper or paperboard, the process comprising:

a) providing a paper or paperboard having a first side and a second side;
b) contacting at least one of the first side and the second side with water or an aqueous composition for a first time period to provide a wet paper or paperboard;
c) contacting the wet paper or paperboard with a wet strength resin composition for a second time period to provide a treated paper or paperboard; and
d) drying the treated paper or paperboard.

Generally, use of the term "paperboard" includes paper, linerboard, or any paper or paperboard product. Accordingly, any disclosure of any of these paper products is to be considered a disclosure of each of the other paper products, and the processes, compositions, and methods related to imparting wet strength to one of these paper products throughout this disclosure apply to the other paper products as well.

In the process disclosed above, the steps b and c can be carried out on the first side of the paper or paperboard and subsequently repeated on the second side of the paper or paperboard, if desired, in which the compositions used in each of steps b and c can be the same or can be different. Further, while this process can be carried out on paper or paperboard that has been previously treated or previously untreated with a wet strength resin at the process wet end, advantages in cost and simplicity are gained when the process is carried out using previously untreated paper or paperboard and linerboard.

It has been discovered that the wet strength (wet mullen) attained by the disclosed method approaches that attained in a conventional wet end application of wet strength compositions. In particular, it has been unexpectedly discovered that when water or an aqueous composition is used for a "pretreatment" step, prior to contacting or treatment with a wet strength resin composition, substantial and unexpected improvements in wet strength are attained. When the aqueous composition used for the "pretreatment" step and/or the wet strength resin used in the subsequent contacting step include a surfactant, even further gains in wet strength are observed.

While not intending to be bound by theory, it is thought that when a portion of the inter-fiber hydrogen bonding of the cellulose fibers making up the paper or paperboard are at least partially disrupted with water or an aqueous composition, the subsequent step of contacting the cellulose fibers with wet strength resin composition, in which those fibers having partially disrupted inter-fiber hydrogen bonding, allows improved contact with the fibers and better overall penetration of the wet strength resin into the paper or paperboard. Using a surfactant in the water, that is, using an aqueous surfactant composition for the pretreatment step, enhances this disruption further and provides improved results.

Thus, accord to a further aspect, this disclosure provides for paper or paperboard having improved wet strength, the paper or paperboard comprising a treated fibrous web, in which the treated fibrous web can comprise:

a) cellulose fibers, a portion of which having intact inter-fiber hydrogen bonding and a portion of which having inter-fiber hydrogen bonding at least partially disrupted with water or an aqueous composition;
b) a wet strength resin composition in contact with the cellulose fibers having partially disrupted inter-fiber hydrogen bonding.

It has been unexpectedly discovered that the wet strength (wet mullen) attained by the disclosed method approaches that attained in a conventional wet end application of wet strength compositions.

Each of the various components that are useful in the disclosed process and each of the various process steps are described herein below.

Surfactants

According to an aspect of this disclosure, one process for improving the wet strength of paper or paperboard comprises contacting at least one of the first side and the second side with water or an aqueous composition for a first time period to provide a wet paper or paperboard, and contacting the wet paper or paperboard with a wet strength resin composition for a second time period to provide a treated paper or paperboard. The aqueous composition used in the first step, the wet strength resin composition used in the second step, or both can comprise at least one surfactant, if desired. Moreover, the surfactants used in the first step and second step can be selected independently of each other.

In some aspects, these steps recited above can be carried out on the first side of the paper or paperboard, and subsequently repeated on the second side of the paper or paperboard, and in this aspect, the surfactants (or absence thereof) used in the first step and second step treatment of the first side can be selected independently of the surfactants (or absence thereof) used in the first step and second step treatment of the second side. In such embodiments and aspects, the surfactant(s) used in each of these steps can be selected independently of each other.

The aqueous composition, the wet strength resin composition, or both compositions can comprise(s) at least one surfactant, and the surfactant(s) can comprise or can be selected independently from a nonionic surfactant, an anionic surfactant, a cationic surfactant, or an amphoteric surfactant. Combinations can be used when compatible with each other and/or any preceding or subsequent step.

In one aspect, examples of suitable surfactants that can be used in the aqueous composition, the wet strength resin composition, or both compositions include but are not limited to, a surfactant selected independently from a polyoxyalkylene, an adduct of an alkylene oxide and an alcohol, an alkyl polyglucoside, a fatty alcohol, a hydrocarbylsulfonate, a sulfate ester, a phosphate ester, a quaternary ammonium compound, a betaine compound, an aminohydrocarbyl sulfonate, a silicone-based surfactant, a phenol, a mercaptan, a carboxylic acid, and any combination thereof. Moreover, the suitable surfactants that can be used in the aqueous composition, the wet strength resin composition, or both compositions can comprise any of the surfactants recited immediately above.

In accordance with another aspect, surfactants that can be used in the aqueous composition, the wet strength resin composition, or both compositions include but are not limited to, surfactants selected independently from or comprising a polyethylene glycol, a polypropylene glycol, a polyoxyethylene glycol alkyl ether, a polyoxypropylene glycol alkyl ether, a glucoside alkyl ether, a polyoxyethylene glycol alkylphenol ether, a glycerol alkyl ester, a polysorbate, a polyethoxylated tallow amine, a polyol, an acetylenic diol, an ethoxylated acetylenic diol, an ethoxylated amine, an ether amine, an amine oxide, and/or any combination thereof.

A further aspect of this disclosure provides surfactants that can be used in the aqueous composition, the wet strength resin composition, or both compositions. The surfactants can include, but are not limited to, surfactants selected independently from or comprising saponified fatty acids, alkylsulfonates, arylsulfonates, alkyl(aryl)sulfonates, alkylether sulfates, sulfate esters, phosphate esters, alkyl phosphates, dialkyl phosphates, aryl phosphates, diaryl phosphates, alkyl(aryl)phosphates, alkylphosphonate, arylphosphonate, alkyl(aryl)phosphonates, aminoalkyl phosphonic acid, mono-ethanolamine, di-ethanolamine, tri-ethanolamine, and/or any combination thereof.

Still a further aspect of this disclosure provides surfactants that can be used in the aqueous composition, the wet strength resin composition, or both compositions include but are not limited to, surfactants selected independently from or comprising a primary amine, a secondary amine, a tertiary amine, a quaternary ammonium compound, a tetraalkyl ammonium compound, an alkyltrimethyl ammonium compound, an alkyl pyridinium compound, a benzalkonium compound, a benzethonium compound, tertiary ammonium compound, a quaternary ester ammonium salt, and any combination thereof.

In accordance with another aspect, surfactants that can be used in the aqueous composition, the wet strength resin composition, or both compositions include but are not limited to, surfactants selected independently from or comprising an alkylbetaine, an alkylamidopropylbetaine, an arylamidopropylbetaine, an aminoalkylsulfonate, an aminoarylsulfonate, an aminoalkyl(aryl)sulfonates, an amino alkylether sulfates, an amidoalkyl hydroxyl sultaine, a lecithin and any combination thereof.

Generally, the aqueous composition and the wet strength resin composition can comprise the surfactant in any concentration. In all the concentrations provided in this disclosure, the surfactant concentration in the aqueous composition and in the wet strength resin composition can be selected independently of each other. That is, a relatively high or concentration in one of these compositions does not dictate or require any particular concentration in the other composition, nor does it require the presence of surfactant in the other composition.

In some aspects for example, the aqueous composition and the wet strength resin composition can independently comprise(s) from 0% to about 20% by weight surfactant. In further aspects, the aqueous composition and the wet strength resin composition can independently comprise(s) from about 0 weight % up to about 19 weight % surfactant; alternatively, up to about 18 weight %; alternatively, up to about 17 weight %; alternatively, up to about 16 weight %; alternatively, up to about 15 weight %; alternatively, up to about 14 weight %; alternatively, up to about 13 weight %; alternatively, up to about 12 weight %; alternatively, up to about 11 weight %; alternatively, up to about 10 weight %; alternatively, up to about 9 weight %; alternatively, up to about 8 weight %; alternatively, up to about 7 weight %; alternatively, up to about 6 weight %; alternatively, up to about 5 weight %; alternatively, up to about 4 weight %; alternatively, up to about 3 weight %; alternatively, from 0 weight % to about 2 weight %; or alternatively up to about 1 weight % surfactant.

In other aspects for example, the aqueous composition and the wet strength resin composition can independently comprise(s) from about 0.001% to about 15% by weight surfactant. In further aspects, the aqueous composition and the wet strength resin composition can independently comprise(s) from about 0.001% to about 15% by weight surfactant; alternatively, from about 0.002% to about 14% by weight surfactant; alternatively, from about 0.004% to about 13% by weight surfactant; alternatively, from about 0.006% to about 12% by weight surfactant; alternatively, from about 0.008% to about 11% by weight surfactant; alternatively, from about 0.01% to about 10% by weight surfactant; alternatively, from about 0.02% to about 9% by weight surfactant; alternatively, from about 0.03% to about 8% by weight surfactant; alternatively, from about 0.04% to about 7% by weight surfactant; alternatively, from about 0.05% to about 6% by weight surfactant; alternatively, from about 0.06% to about 5% by weight surfactant; alternatively, from about 0.07% to about 4% by weight surfactant;

alternatively, from about 0.08% to about 3% by weight surfactant; alternatively, from about 0.09% to about 2% by weight surfactant; alternatively, from about 0.095% to about 1.5% by weight surfactant; or alternatively, from about 0.1% to about 1% by weight surfactant.

As disclosed herein, any surfactant can be employed according to this disclosure to improve the wet strength of paper, paperboard and linerboard, and the surfactant can be used as part of the aqueous composition used to pretreat the paper, paperboard or linerboard and/or as an additional component of the wet strength resin composition. Examples of nonionic, anionic, cationic, or amphoteric surfactants are provided. Aspects of the disclosure are demonstrated using nonionic surfactants, such as Triton® X-100, which is polyethylene glycol p-(1,1,3,3-tetramethylbutyl)-phenyl ether. This nonionic surfactant includes a hydrophilic polyethylene oxide chain (on average about 9.5 ethylene oxide units) and an aromatic hydrocarbon lipophilic or hydrophobic group. Aspects of this disclosure are also demonstrated using the Surfynol® series of nonionic surfactants from Air Products and Chemicals. Surfynol® 420, which is a polyethyleneoxylated acetylenic diol surfactant, was particularly used to collect the data presented in this disclosure. According to one aspect, the aqueous composition, the wet strength resin composition, or both compositions comprise(s) Triton® X-100 or Surfynol® 420.

Wet Strength Resin Compositions

This disclosure provides in one aspect, a process for improving the wet strength of paper or paperboard comprises contacting at least one of the first side and the second side with water or an aqueous composition for a first time period to provide a wet paper or paperboard, and contacting the wet paper or paperboard with a wet strength resin composition for a second time period to provide a treated paper or paperboard. As disclosed, the aqueous composition, the wet strength resin composition, or both can comprise at least one surfactant, if desired, and the surfactants used in these two compositions can be selected independently of each other.

The wet strength resin composition can be or can comprise any suitable wet strength resin composition. In one aspect, for example, wet strength resin composition can comprise or can be selected from an aliphatic aldehyde, an aromatic aldehyde, a urea-formaldehyde resin, a melamine formaldehyde resin, and/or a polyamide-epihalohydrin resin. A further aspect provides that the wet strength resin composition can comprise or can be selected from an epihalohydrin-modified polyamine, polyamidoamine, polyethyleneimine (PEI), polyvinyl amine, and/or a combination thereof.

For example, the wet strength resin composition can comprise or can be selected from an epihalohydrin-modified polyamine, in which the polyamine has the following structure (I):

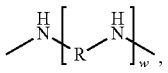

and wherein R is alkyl, hydroxyalkyl, amide, aryl, heteroaryl, cycloalkyl, or poly-primary amine (such as polyvinyl amine and its copolymers), and w is an integer from 1 to about 10,000. Generally, the polyamine in this aspect can have a molecular weight of about 2,000 to about 1,000,000. Alternatively, the polyamine can have a molecular weight of about 5,000 to about 500,000; alternatively, from about 10,000 to about 200,000; or alternatively, from about 15,000 to about 100,000. The epihalohydrin used to modify the polyamine can be selected from epichlorohydrin, epibromohydrin, and epiiodohydrin.

By way of example, in one aspect, the polyamine, which may be referred to herein as a polyamine prepolymer, can have structure (I) as illustrated above wherein R can be selected as provided herein, in which w can be an integer from 1 to about 30; alternatively, from 1 to about 20; alternatively, from 1 to about 15; alternatively, from 1 to about 12; alternatively, from 1 to about 10; or alternatively, from 1 to about 5. In another aspect, w can be 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30. These "R" groups, for example "alkyl", are intended to provide a convenient description of the specified groups that are derived from formally removing one or more hydrogen atoms (as needed for the particular group) from the parent group. Therefore, the term "alkyl" in structure (I) would apply the conventional rules of chemical valence to apply, but would include, for example, an "alkanediyl group" which is formed by formally removing two hydrogen atoms from an alkane (either two hydrogen atoms from one carbon atom or one hydrogen atom from two different carbon atoms). Such an alkyl group can be substituted or unsubstituted groups, can be acyclic or cyclic groups, and/or may be linear or branched unless otherwise specified. A "hydroxyalkyl" group includes one or more hydroxyl (OH) moieties substituted on the "alkyl" as defined.

In this aspect and unless otherwise indicated, alkyl R of structure (I) can be an alkyl moiety that is linear (straight chain) or branched. Moiety R can also be a cycloalkyl, that is, a cyclic hydrocarbon moiety having from 1 to about 25 carbon atoms. For example, R can have from 1 to 25, from 1 to 20, from 1 to 15, from 1 to 12, from 1 to 10, from 1 to 8, from 1 to 6, or from 1 to 4 carbon atoms. Also by way of example, R can have from 2 to 10, 2 to 8, 2 to 6, or 2 to 4 carbon atoms. In a further aspect, R can be a $C_1$ moiety, a $C_2$ moiety, a $C_3$ moiety, a $C_4$ moiety, a $C_5$ moiety, a $C_6$ moiety, a $C_7$ moiety, a $C_8$ moiety, a $C_9$ moiety, a $C_{10}$ moiety, a $C_{11}$ moiety, a $C_{12}$ moiety, a $C_{13}$ moiety, a $C_{14}$ moiety, a $C_{15}$ moiety, a $C_{16}$ moiety, a $C_{17}$ moiety, a $C_{18}$ moiety, a $C_{19}$ moiety, a $C_{20}$ moiety, a $C_{21}$ moiety, a $C_{22}$ moiety, a $C_{23}$ moiety, a $C_{24}$ moiety, a $C_{25}$ moiety, a $C_{26}$ moiety, a $C_{27}$ moiety, a $C_{28}$ moiety, a $C_{29}$ moiety, a $C_{30}$ moiety.

In the polyamine prepolymer structure (I) illustrated supra, R also can be a poly-primary amine, such as polyvinyl amine and its copolymers. Examples of a poly-primary amine that can constitute R in structure (I) include, but are not limited to the following structures, as well as copolymers with olefins and other unsaturated moieties, where n can be an integer from 1 to about 25:

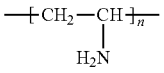

Alternatively, n can be an integer from 1 to about 20; alternatively, from 1 to about 15; alternatively, from 1 to about 12; alternatively, from 1 to about 10; or alternatively, from 1 to about 5. In another aspect, n can be 1, 2, 3, 4, 5, 6, 7, 8, 9, 10, 11, 12, 13, 14, 15, 16, 17, 18, 19, 20, 21, 22, 23, 24, or 25.

Suitable polyamines (polyamine prepolymers) for use in preparing the resins of this disclosure include, but are not limited to, polyalkylene polyamines, such as polyethylenepolyamines including diethylenetriamine (DETA), triethylenetetramine (TETA), aminoethyl piperazine, tetraethylenepentamine, pentaethylenehexamine, N-(2-aminoethyl) piperazine, N,N-bis(2-aminoethyl)-ethylenediamine, diaminoethyl triaminoethylamine, piperazinethyl triethylenetetramine, and the like. Also useful in preparing polyamine prepolymers for use in the resin preparations of this disclosure include, ethylene diamine, low molecular weight polyamidoamines, polyvinylamines, polyethyleneimine (PEI) and copolymers of vinyl amine with other unsaturated co-polymerizable monomers such as vinyl acetate and vinyl alcohol.

According to an aspect of polyamine prepolymer (I), w is a number range corresponding to the polyamine prepolymer Mw mol number from about 2,000 to about 1,000,000. The Mw molecular weight of polyamine prepolymer P can also can be from about 5,000 to about 750,000; alternatively, from about 7,500 to about 500,000; alternatively, from about 10,000 to about 200,000; alternatively, from about 20,000 to about 150,000; or alternatively, from about 30,000 to about 100,000.

A range of polyamidoamine prepolymers also can be used as a precursor to the wet strength resins according to this disclosure. The polyamidoamine prepolymers are made by the reaction of a polyalkylene polyamine having at least two primary amine groups and at least one secondary amine group with a dicarboxylic acid, in a process to form a long chain polyamide containing the recurring groups as disclosed herein. In one aspect, the polyamidoamine prepolymer can have the following structure (II):

(II)

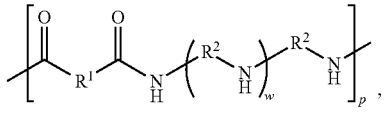

wherein $R^1$ is $(CH_2)_m$ where m is 2, 3, 4, or 5; $R^2$ is $(CH_2)_n$ where n is 2, 3, or 4; w is 1, 2, or 3; and p is a number range corresponding to the polyamidoamine prepolymer Mw molecular weight from about 2,000 to about 1,000,000. The Mw molecular weight also can be from about 5,000 to about 100,000; alternatively, from about 7,500 to about 80,000; alternatively, from about 10,000 to about 60,000; alternatively, from about 20,000 to about 55,000; or alternatively, from about 30,000 to about 50,000.

In an aspect, the polyamidoamine prepolymer can have the following structure (III):

(III)

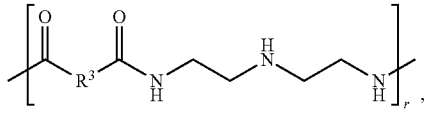

wherein $R^3$ is $(CH_2)_q$ where q is ranging from 0 to 40; and r is a number range corresponding to the polyamidoamine prepolymer Mw molecular weight from about 2,000 to about 1,000,000. Similarly, the Mw molecular weight also can be from about 5,000 to about 100,000; alternatively, from about 7,500 to about 80,000; alternatively, from about 10,000 to about 60,000; alternatively, from about 20,000 to about 55,000; or alternatively, from about 30,000 to about 50,000. Thus, in the structure $(CH_2)_q$, q can also range from 0 to about 40; alternatively, from 0 to about 35; alternatively, from 0 to about 30; alternatively, from 0 to about 25; alternatively, from 0 to about 20; alternatively, from 0 to about 15; alternatively, from 0 to about 12; alternatively, from 1 to about 12; alternatively, from 1 to about 10; alternatively, from 1 to about 8; or alternatively, from 1 to about 6.

In a further aspect, the polyamidoamine prepolymer also may have the following structure (IV):

$$—[—NH(C_nH_{2n}—NH)_p—CO—(CH_2)_m—CO—]—, \quad (IV)$$

wherein n is 1 to 8; p is 2 to 5; and m is 0 to 40, and similar molecular weight ranges apply.

As disclosed, suitable polyamidoamines are generally prepared by reacting a dicarboxylic acid (diacid), or a corresponding dicarboxylic acid halide or diester thereof, with a polyamine such as a polyalkylene polyamine. Suitable polyamines include those polyamines (polyamine prepolymers) disclosed herein that can be used as precursors for the wet strength resins themselves. For example, useful polyamidoamines can be made by reacting suitable polyalkylene polyamines, such as polyethylenepolyamines including ethylenediamine itself, Diethylenetriamine (DETA), triethylenetetramine (TETA), aminoethyl piperazine, tetraethylenepentamine, pentaethylenehexamine, N-(2-aminoethyl)piperazine, N,N-bis(2-aminoethyl)-ethylenediamine, diaminoethyl triaminoethylamine, piperazinethyl triethylenetetramine, and the like, with polycarboxylic acids such as succinic, glutaric, 2-methylsuccinic, adipic, pimelic, suberic, azelaic, sebacic, undecanedioic, dodecandioic, 2-methylglutaric, 3,3-dimethylglutaric and tricarboxypentanes such as 4-carboxypimelic; alicyclic saturated acids such as 1,2-cyclohexanedicarboxylic, 1-3-cyclohexanedicarboxylic, 1,4-cyclohexanedicarboxylic and 1-3-cyclopentanedicarboxylic; unsaturated aliphatic acids such as maleic, fumaric, itaconic, citraconic, mesaconic, aconitic and hexane-3-diotic; unsaturated alicyclic acids such as A4-cyclohexenedicarboxylic; aromatic acids such as phthalic, isophtalic, terephthalic, 2,3-naphthalenedicarboxylic, benzene-1,4-diacetic, and heteroaliphatic acids such as diglycolic, thiodiglycolic, dithiodiglycolic, iminodiacetic and methyliminodiacetic. Usually, diacids and their related diesters of the formula $RO_2C(CH_2)_nCO_2R$ (where n=1 to 10 and R=H, methyl, or ethyl) and mixtures thereof are preferred. Adipic acid is readily available and is often used.

In epihalohydrin-modified polyamine wet strength resin compositions of this type, the polyamine can be reacted with a mono-functional modifier prior to, during, or after treating with the epihalohydrin. The mono-functional modifier can comprise or can be selected from a neutral or cationic acrylate compound, a neutral or cationic acrylamide compound, an acrylonitrile compound, a mono-epoxide compound, and/or a combination thereof. For example, the mono-functional modifier can comprise or can be selected from an alkyl acrylate, acrylamide, an alkyl acrylamide, a dialkyl acrylamide, acrylonitrile, a 2-alkyl oxirane, a 2-(allyloxyalkyl)oxirane, a hydroxyalkyl acrylate, an ω-(acryloyloxy)-alkyltrimethylammonium compound, an ω-(acrylamido)-alkyltrimethylammonium compound, and/or any combination thereof. Specific examples of mono-functional modifiers include, but are not limited to, methyl acrylate, alkyl acrylate, acrylamide, N-methylacrylamide, N,N-dimethylacrylamide, acrylonitrile, 2-methyl-oxirane, 2-ethyloxirane, 2-propyloxirane, 2-(allyloxymethyl)oxirane, 2-hydroxyethyl acrylate, 2-(2-hydroxyethoxy)ethyl acrylate, 2-(acryloyloxy)-N,N,N-trimethylethanaminium, 3-(acryloyloxy)-N,N,N-trimethylpropan-1-aminium, 2-acrylamido-N,N,N-trimethylethanaminium, 3-acrylamido-N,N,N-trimethylpropan-1-aminium, and 1-isopropyl-3-(methacryloyloxy)-1-methylazetidinium chloride.

Generally, in an aspect, the wet strength resin composition can comprise an epihalohydrin-modified polyamine wet strength resin selected from polyaminoamide-epihalohydrin resins, polyamidepolyamine-epihalohydrin resins, polyaminepolyamide-epihalohydrin resins, aminopolyamide-epihalohydrin resins, polyamide-epihalohydrin resins polyalkylene polyamine-epihalohydrin resins, polyaminourylene-epihalohydrin resins, copolyamide-polyurylene-epichlorohydrin resins, and polyamide-polyurylene-epichlorohydrin resins. In a further aspect, the wet strength resin composition can comprise a polyamidoamine-epichlorohydrin resin, a polyamine-epichlorohydrin resin, or a combination thereof.

In one aspect, the pH of the wet strength resins can be adjusted using an acid, for example, acetic acid, formic acid, hydrochloric acid, phosphoric acid, sulfuric acid, organic acid or mineral acid or a combination thereof. In an aspect, the pH of the resin can be adjusted to a pH of about pH 1.0 to about pH 6.0; alternatively, from about pH 2.0 to about 5.0; or alternatively, from about. pH 2.0 to about pH 4.5.

In another aspect, the solids content of the resin can be adjusted from about 5% to about 50% solids, by weight; alternatively, from about 7% to about 40% solids, by weight; alternatively, from about 10% to about 30% solids, by weight; alternatively, from about 12.5% to about 25% solids, by weight; or alternatively, from about 15% to about 20% solids, by weight. The resin according to this aspect can have a charge density from about 0.025 to about 7.0 mEq/g of solids; alternatively, from about 0.05 to about 6.0 mEq/g of solids; alternatively, from about 0.075 to about 5.0 mEq/g of solids; alternatively, from about 1.0 to about 4.0 mEq/g of solids; or alternatively, from about 1.5 to about 3.5 mEq/g of solids.

Process & Product Produced

This disclosure provides a process for improving the wet strength of paper or paperboard, in which the paper or paperboard is previously untreated with a wet strength resin at the process wet end, or alternatively, the paper or paperboard is previously treated with a wet strength resin at the process wet end. Based upon a comparison with untreated paper or paperboard, the wet mullen of the paper or paperboard treated according to this disclosure can be from about 1.0 to about 4.0 times greater than the wet mullen of the paper or paperboard prior to treating. Alternatively, the wet mullen of the pretreated paper or paperboard that is subsequently treated with wet strength resins according to this disclosure can be from about 1.2 to about 3.8 times greater than the wet mullen of the paper or paperboard prior to treating; alternatively, from about 1.5 to about 3.5 times greater; or alternatively, from about 2.0 to about 3.0 times greater.

Specifically, it has been unexpectedly discovered that the wet strength of the paper or paperboard provided by the disclosed method can approach that attained in a conventional wet end application of wet strength compositions. One aspect of the present disclosure provides a process for improving the wet strength of paper or paperboard, comprising:

a) providing a paper or paperboard having a first side and a second side;
b) contacting at least one of the first side and the second side with water or an aqueous composition for a first time period to provide a wet paper or paperboard; and
c) contacting the wet paper or paperboard with a wet strength resin composition for a second time period to provide a treated paper or paperboard.

Paper or paperboard that is treated in this manner generally is dried and deployed in any number of container and packaging applications. Referring to this process description, there is no requirement that the first side and the second side be pretreated at the same time and subsequently be contacted with a wet strength resin composition at the same time. Thus, steps b and c can be carried out on the first side of the paper or paperboard, and subsequently repeated on the second side of the paper or paperboard. Alternatively, step b can be carried out on the first side and the second side of the paper or paperboard, and subsequently step c can be carried out on the first side and the second side of the paper or paperboard repeated on the second side of the paper or paperboard. Alternatively still, steps b and c can be carried out on the first side of the paper or paperboard only. Drying steps can follow at any time after any step c of contacting either or both sides of the wet paper or paperboard with a wet strength resin composition.

This disclosure also provides for the paper or paperboard itself having improved wet strength and comprising a treated fibrous web, the treated fibrous web comprising:

a) cellulose fibers, a portion of which having intact inter-fiber hydrogen bonding and a portion of which having inter-fiber hydrogen bonding at least partially disrupted with water or an aqueous composition;
b) a wet strength resin composition in contact with the cellulose fibers having partially disrupted inter-fiber hydrogen bonding.

It is thought that, while not bound by theory, a portion of the inter-fiber hydrogen bonding of the cellulose fibers making up the paper or paperboard are at least partially disrupted with water or an aqueous composition. The subsequent step of contacting the cellulose fibers with wet strength resin composition, in which those fibers having partially disrupted inter-fiber hydrogen bonding, allows improved contact with the fibers and better overall penetration of the wet strength resin into the paper or paperboard. Using a surfactant in the water, that is, using an aqueous surfactant composition for the pretreatment step, enhances this disruption further and provides improved results.

The present process includes the steps of: b) contacting at least one of the first side and the second side with water or an aqueous composition for a first time period to provide a wet paper or paperboard; and c) contacting the wet paper or paperboard with a wet strength resin composition for a second time period to provide a treated paper or paperboard. The first and second periods of time can vary considerably. While not intending to be bound by theory, in general, the first period of time during which the first side and/or the second side of the paper or paperboard is/are contacted with water or an aqueous composition is about the time required to at least partially disrupt the inter-fiber hydrogen bonding of the contacted side of the paper or paperboard. In general, the second period of time during which the precontacted side of the paper or paperboard is contacted with a wet strength resin composition is about the time required for the composition to impart at least some additional wet strength to the paper or paperboard, as compared with the untreated paper or paperboard.

Variations are possible within the overall process regarding the contacting steps of: b) contacting at least one of the first side and the second side with water or an aqueous composition for a first time period to provide a wet paper or paperboard; and c) contacting the wet paper or paperboard with a wet strength resin composition for a second time period to provide a treated paper or paperboard. For example, in one aspect, contacting step b) can be carried out once or more than once prior to carrying out any contacting step c). Similarly, in another aspect, contacting step c) can be carried out once or more than once after carrying out any number of contacting steps b). Thus, independently of each other, one or more contacting steps b) can be carried out prior to carrying out one or more contacting steps c).

Further aspects and variations are possible within the overall process regarding the contacting steps of: b) contacting at least one of the first side and the second side with water or an aqueous composition for a first time period to provide a wet paper or paperboard; and c) contacting the wet paper or paperboard with a wet strength resin composition for a second time period to provide a treated paper or paperboard. For example, independently of each other, one or more contacting steps b) can be carried out prior to carrying out one or more contacting steps c), and the step b) followed by step c) sequences can be repeated any number of times. Moreover, there is no limitation that the first step b) followed by step c) sequence be the same as any subsequent step b) followed by step c) contacting steps. By way of example, independently of each other, a first sequence comprising any number of contacting steps b) can be carried out prior to carrying out any number of contacting steps c); followed by any number of subsequent sequences comprising any number of contacting steps b) can be carried out prior to and independently of carrying out any number of contacting steps c).

Just as the basic contacting step b) is carried out for a first time period and step c) is carried out for a second time period, and these first and second time periods can vary over a wide range, in general, there are no limitations on the time period (how long) any of the individual contacting steps must occur. That is, there are no limitations on the time period between any individual step b), optional subsequent steps b), step c), or subsequent steps c) that must lapse prior to commencing the following contacting or drying step.

The first time period and the second time period are contact times between any subsequent coating step or the step d) of drying. Because any contacting period of any step b) and step c) recited above can range from a few fractions of a second (for example, 0.005 seconds) to multiple days (for example, 3 days), some drying may occur during the "contacting" time periods, and this drying can be significant for the longer contacting periods. In general, when reciting elapsed times for the first and second time periods of any of the contacting steps b) and c), it is intended to include the time from the application of the water, aqueous composition, or wet strength resin composition until any subsequent contacting step of a later application of any type or the step d) of drying the treated paper or paperboard.

In this aspect, for example, it is possible to conduct the application steps b) and c) in two passes over the same applicator, with step b) constituting the first pass and step c) constituting the second pass. For example, some mills may choose to carry out the process in this manner in which case the contact times (first and/or second time periods) can be from minutes to days. By way of example, any of the first and/or second time periods or contact times can be selected from about 1, about 2, about 3, about 4, about 5, about 6, about 7, about 8, about 9, about 10, about 15, about 20, about 30, about 40, about 50, or about 60 minutes. In another aspect, for example, any of the first and/or second time periods or contact times can be selected from about 1, about 2, about 3, about 4, about 5, about 6, about 7, about 8, about 9, about 10, about 11, about 12, about 13, about 14, about 15, about 16, about 17, about 18, about 19, about 20, about 21, about 22, about 23, about 24, about 30, about 36, about 42, or about 48 hours.

In a further aspect, it may be more common and cost effective to apply both coatings in a single pass using two separate applicators corresponding to the step b) and step c) contacting steps, respectively. In this aspect, for example, any of the first and/or second time periods or contact times can be selected from about 0.002, about 0.005, about 0.01, about 0.02, about 0.03, about 0.04, about 0.05, about 0.06, about 0.07, about 0.08, about 0.09, or about 0.1 seconds. In further aspects, any of the first and/or second time periods or contact times can be selected from about about 0.2, about 0.3, about 0.4, about 0.5, about 0.6, about 0.7, about 0.8, about 0.9, about 1, about 2, about 3, about 4, about 5, about 6, about 7, about 8, about 9, about 10, about 15, about 20, about 30, about 40, about 50, or about 60 seconds.

In the process for the application of coatings, whether water, an aqueous composition, or a wet strength resin composition to the paper, paperboard or linerboard, any application process can be used and the present method is not limited to a particular process. For example, and not by limitation, there are multiple different rods that could be used to apply the coatings. It is understood by the person of ordinary skill that rods are numbered to indicate the groove or wire winds on the rods. Thus, a #0 rod is smooth and rods ranging from #1 to #20+ are characterized by having progressively larger grooves or wires that are profiled or wound onto the rods. For the data reported in the Examples, both #0 and #8 rods were used to apply coatings of wet strength resin and the combination of wet strength resin and surfactant, with the smooth #0 rod metering less solution than the #8 grooved rod. However, the present process is not limited to any rod groove numbers and not limited by any requirement that they be applied using rods. For example, any number of other types of applicators can be used to apply these solutions. These applicators can be described broadly as film metering applicators. Another common applicator type available to paper mills that are suitable for the disclosed process are flooded nip size presses. Spray applicators are also useful and well-suited for applying the initial treatment according to this disclosure.

Referring now to the examples, Example 1 describes the preparation of samples for comparative testing, including both control samples and samples according to the disclosure, and the substrate, coatings, and application specifics are provided in Table 1. Both water only and an aqueous composition comprising surfactant were used to pretreat the paperboard, which were then coated with a wet strength resin, both with and without surfactant. Samples 1 and 2 of Table 1 were not subject to pretreatment with water or an aqueous composition, while Samples 3-6 were subject to pretreatment with water or aqueous surfactant, as listed. None of Samples 1-6 was previously subjected to a traditional wet end application.

Example 2 and Table 2 set out the testing protocol and data for the wet strength tests (wet mullen) of the paperboard samples that were not pretreated with water or an aqueous composition. The wet strength of these samples were compared to that of untreated paperboard (Sample C1) and conventional, wet end treated paperboard (Sample C2). The best performance was obtained with standard wet strength treated paperboard (Sample C2), with the wet mullen of the standard wet strength paperboard measured at about four times that of the untreated paperboard. On average, the test Samples 1 and 2 without pretreatment exhibited only about one-third the wet strength of the conventional wet end treated standard, with the best data observed from applying larger amounts of surfactant along with the wet strength resin.

Example 3 and Table 3 set out data for the wet strength tests (wet mullen) of the paperboard samples that were pretreated in accordance with this disclosure, Samples 3-6, and compares their wet strength performance with Samples 1 and 2 without pretreatment and with untreated paperboard (Sample C1) and conventional, wet end treated paperboard (Sample C2). The wet strength performance for all samples that were pretreated significantly improved over Samples 1 and 2 without pretreatment and over untreated paperboard (Sample C1), and approached the performance of conventional, wet end treated paperboard (Sample C2). Specifically, the data for Samples 3-6 revealed that in each case the aqueous surfactant solution pretreatment provided somewhat improved results as compared to water only pretreatment. For the pretreated Samples 3-6, the use of wet strength resin plus surfactant also gave improved results as compared to wet strength resin coating only. The Samples 3-6 tests averaged about 61% of the wet mullen of the standard wet strength treated paperboard (Table 3), representing a near 100% improvement over the samples with no pretreatment (Table 2). The best results were obtained using surfactant in both aqueous composition pretreatment and in wet strength resin coating composition, which has a wet mullen of two-thirds that of the standard wet strength treated paperboard.

Other process parameters that can be adjusted in accordance with this disclosure include, but are not limited to: 1) wet strength resin composition solids content and extent of dilution prior to application; 2) multiple coatings, such as a second wet strength resin composition coating applied immediately after the first; 3) surfactant concentration in the aqueous composition and/or wet strength resin composition; 4) surfactant composition or combinations of surfactants used in the aqueous composition and/or wet strength resin composition; 5) higher solution temperatures to aid penetration; 6) drying time and temperature; 7) application method, including application rod numbers, for both the aqueous composition and the wet strength resin; and 8) optimizing the combination of these parameters to develop the desired depth of penetration of the wet strength resin.

The disclosed process is versatile in that it is useful for improving the wet strength of paper or paperboard that is previously untreated with a wet strength resin at the process wet end and also useful for improving the wet strength of paper or paperboard that is previously treated with a wet strength resin at the process wet end. The present disclosure also provides for paper or paperboard that has improved wet strength, regardless of whether that paper or paperboard was previously treated or untreated, when prepared according to the disclosed processes.

Thus, it has been unexpectedly discovered that the wet strength (wet mullen) attained by the disclosed method can exceed that attained in a conventional wet end application of wet strength compositions, when it is applied to previously treated paper or paperboard. That is, in one aspect, there is provided a process for improving the wet strength of paper or paperboard, comprising:

a) providing a paper or paperboard treated with a wet strength resin at the wet end, the paper or paperboard having a first side and a second side;
b) contacting at least one of the first side and the second side with water or an aqueous composition for a first time period to provide a wet paper or paperboard; and
c) contacting the wet paper or paperboard with a wet strength resin composition for a second time period to provide a treated paper or paperboard.

Accordingly, paper or paperboard that is both treated with a wet strength resin at the wet end, pretreated with water or aqueous composition, and finally surface contacted with a wet strength resin composition in this manner, generally is dried and deployed in any number of container and packaging applications. This type of "double" treated paper or paperboard that is both internally and externally treated with a wet strength resin shows improved wet strength over paper or paperboard that has been only internally or only externally treated with a wet strength resin.

Further, this internal and external treatment can increase stiffness, reduce air permeability, and further boost wet strength.

A number of paper and paperboard properties can be influenced when subjected to the process according to this disclosure. For example, paper and paperboard properties that can be improved using the disclosed process include, but are not limited to, porosity, stiffness (wet and dry), wet and dry tensile, wet and dry mullen, STIFI (wet and dry), tear (wet and dry), and the like.

Additional Components

In addition to treating the paper or paperboard according to this disclosure to improve wet strength, the aqueous composition, the wet strength resin composition, or both can comprise additional components for other functions, if desired. These components are optional components of the process and of the composition used for the process disclosed herein. The additional optional components can include, for example, colorants, pigments, dyes, sizing compositions, starch, latex, fluorochemicals, guar gum, polyacrylamides, carboxymethyl celluloses, and the like, including suitable combinations thereof. For example, suitable fluorochemicals can be selected from, among other things, perfluorinated polyacrylates, perfluorinated polyurethanes, linear perfluoropolyethers, molecules possessing single or twin perfluorinated chains, including those in the form of carboxylate and phosphate salts such as amphoteric and ammonium salt derivatives, a perfluoroalkyl chain or chains attached to a polar functional group, polytetrafluoroethylene, perfluoroalkyl substituted carboxylic acids, and the like.

Definitions and General Disclosure

Unless otherwise indicated, the following definitions are applicable to this disclosure. If a term is used in this disclosure but is not specifically defined herein, the definition from the Academic Press Dictionary of Science and Technology (c. 1992, Academic Press, Inc., San Diego, Calif., ISBN 0-12-200400-0) can be applied, as long as that definition does not conflict with any other disclosure or definition applied herein, or render indefinite or non-enabled any claim to which that definition is applied. To the extent that any definition or usage provided by any document incorporated by reference conflicts with the definition or usage provided herein, the definition or usage provided herein controls. Thus, in this specification and in the claims that follow, reference will be made to a number of terms, which shall be defined to have the following meanings While compositions and methods are described in terms of "comprising" various components or steps, the compositions and methods can also "consist essentially of" or "consist of" the various components or steps, unless specifically otherwise stated.

"Optional" or "optionally" means that the subsequently described event or circumstance can or cannot occur, and that the description includes instances where the event or circumstance occurs and instances where it does not.

By the terms "essentially" or "substantially", or other forms of the word such as "substantial", it is meant a deviation from the stated value of less than 10%, less than 5%, or less than 2%.

By "treat" or other forms of the word, such as "treated" or "treatment," it is intended to reflect contact between the material that is being treated (contacted) and the composition that is used for treatment (contact). Such terms do not reflect any specific chemical or physical mechanism or reaction which is operative or required to occur during the contacting step or steps, or any specific outcome.

The terms "pretreat" or other forms of the word, such as "pretreatment" or "pretreated" are intended to reflect a first contact step that occurs or is initiated before a second contact step.

That is, such terms reflect relative times of the occurrence or initiation of different contacting steps between the material that is being treated (contacted) and the composition that is used for treatment (contact). As with terms "treat" and the like, such terms do not reflect any specific chemical or physical mechanism or reaction which is operative or required to occur during the contacting step or steps, or any specific outcome.

The term "substantially free", for example when describing a composition that is substantially free of a particular component, such as a compound or material, is meant to reflect that none of the recited component is intentionally added or used in the subject composition.

The term "alkyl" as used herein is a branched or unbranched saturated hydrocarbon group of 1 to 40 carbon atoms, such as methyl, ethyl, n-propyl, isopropyl, n-butyl, isobutyl, t-butyl, pentyl, hexyl, heptyl, octyl, nonyl, decyl, dodecyl, tetradecyl, hexadecyl, octadecyl, eicosyl, tetracosyl, and the like. The alkyl group can also be substituted or unsubstituted. The alkyl group can be substituted with one or more groups including, but not limited to, alkyl, halogenated alkyl, alkoxy, alkenyl, alkynyl, aryl, heteroaryl, aldehyde, amino, carboxylic acid, ester, ether, halide, hydroxy, ketone, sulfo-oxo, sulfonylamino, nitro, silyl, or thiol, as described below. Throughout the specification "alkyl" is generally used to refer to both unsubstituted alkyl groups and substituted alkyl groups; however, substituted alkyl groups may be specifically referred to herein by identifying the specific substituent(s) on the alkyl group. For example, the term "alkyl halide" specifically refers to an alkyl group that is substituted with one or more halides, e.g., fluorine, chlorine, bromine, or iodine. When "alkyl" is used in one sentence and a specific term such as "alkyl halide" is used in another, it is not meant to imply that the term "alkyl" does not also refer to specific terms such as "alkyl halide" and the like.

The term "cycloalkyl group" as used herein is a general term that refers to a group formed by removing one or more hydrogen atoms (as needed for the particular group) from a cycloalkane. Therefore, an "cycloalkyl group" includes the definition specified by IUPAC of a univalent group formed by formally removing a hydrogen atom from an cycloalkane but also includes, for example, an "cycloalkanediyl group" which is formed by formally removing two hydrogen atoms from an alkane (either two hydrogen atoms from one carbon atom or one hydrogen atom from two different carbon atoms) when the context requires or allows, as long as the usual rules of chemical valence are applied. An alkyl group can be substituted or unsubstituted groups, can be acyclic or cyclic groups, and/or may be linear or branched unless otherwise specified. When two hydrogens are formally removed from cycloalkane to form a "cycloalkyl" group, the two hydrogen atoms can be formally removed from the same ring carbon, from two different ring carbons, or from one ring carbon and one carbon atom that is not a ring carbon.

An "aryl group" refers to a group formed by removing one or more hydrogen atoms (as needed for the particular group and at least one of which is an aromatic ring carbon atom) from an aromatic compound, specifically, an arene. Therefore, an "aryl group" includes a univalent group formed by formally removing a hydrogen atom from an arene, but also includes, for example, an "arenediyl group" arising from formally removing two hydrogen atoms (at least one of which is from an aromatic hydrocarbon ring carbon) from an arene. Thus, an aromatic compound is compound containing a cyclically conjugated hydrocarbon that follows the Hiickel (4n+2) rule and containing (4n+2) pi-electrons, where n is an integer from 1 to about 5. Therefore, aromatic compounds and hence "aryl groups" may be monocyclic or polycyclic unless otherwise specified.

A "heteroaryl group" refers to a group formed by removing one or more hydrogen atoms (as needed for the particular group and at least one of which is an aromatic ring carbon or heteroatom) from an heteroaromatic compound. Therefore, the one or more hydrogen atom can be removed from a ring carbon atom and/or from a heteroaromatic ring or ring system heteroatom. Thus, a "heteroaryl" group or moiety includes a "heteroarenediyl group" which arises by formally removing two hydrogen atoms from a heteroarene compound, at least one of which typically is from a heteroarene ring or ring system carbon atom. Thus, in a "heteroarenediyl group," at least one hydrogen is removed from a heteroarene ring or ring system carbon atom, and the other hydrogen atom can be removed from any other carbon atom, including for example, a heteroarene ring or ring system carbon atom, or a non-heteroarene ring or ring system atom.

An "amide" group or moiety refers to a group formed by removing one or more hydrogen atoms (as needed for the particular group) from an amide compound, including an organic amide compound. Therefore, the one or more hydrogen atom can be removed from a carboxyl group carbon, from an amide nitrogen, from any organic moiety bonded to either the carboxyl group carbon or the amide nitrogen, or from an organic moiety bonded to the carboxyl group carbon and an organic moiety bonded to the amide nitrogen. Often, for example, when an amide group links amines in a polyamine, the "amide" group or moiety arises from formally removing an hydrogen atom from each of two organic groups, one bonded to the carboxyl group and the other to the amide nitrogen. This term can be used for any amide moiety, whether the organic groups of the amide or aliphatic or aromatic.

The use of various substituted analogs or formal derivatives of any of these groups may also be disclosed, in which case the analog or formal derivative is not limited to the number of substituents or a particular regiochemistry, unless otherwise indicated. For example, the term "hydroxyalkyl" refers to a group formed by formally removing one or more hydrogen atoms (as needed for the particular group) from the alkyl portion of a hydroxy-substituted alkane. The hydroxy-substituted alkane can include one or more hydroxy substituents. Therefore, a "hydroxyalkyl" group includes, for example, a hydroxy-substituted "alkanediyl" group which is formed by formally removing two hydrogen atoms from a "hydroxyalkyl" alkane (either two hydrogen atoms from one carbon atom or one hydrogen atom from two different carbon atoms) when the context requires or allows, as long as the usual rules of chemical valence are applied. As indicated for an alkyl group, the alkyl group can be substituted or unsubstituted groups, can be acyclic or cyclic groups, and/or may be linear or branched unless otherwise specified. A weight percent of a component, unless specifically stated to the contrary, is based on the total weight of the formulation or composition in which the component is included.

When values are expressed as approximations, by use of the antecedent "about," it will be understood that the particular recited value forms another embodiment. It is also understood that when a particular value is disclosed, "about" that particular value in addition to the value itself. For example, if the value "10" is disclosed, then "about 10" is also disclosed.

Unless indicated otherwise, when a range of any type is disclosed or claimed, for example a range of weight percentages, processing times, and the like, it is intended that the stated range disclose or claim individually each possible number that such a range could reasonably encompass, including any sub-ranges and combinations of sub-ranges encompassed therein. For example, when describing a range of measurements such as weight percentages, every possible number that such a range could reasonably encompass can, for example, refer to values within the range with one significant digit more than is present in the end points of a range. In this example, a weight percentage between 10 percent and 20 percent includes individually 10, 11, 12, 13, 14, 15, 16, 17, 18, 19, and 20 weight percent. Applicant's intent is that these two methods of describing the range are interchangeable. Moreover, when a range of values is disclosed or claimed, which Applicants intent to reflect individually each possible number that such a range could reasonably encompass, Applicants also intend for the disclosure of a range to reflect, and be interchangeable with, disclosing any and all sub-ranges and combinations of sub-ranges encompassed therein. Accordingly, Applicants reserve the right to proviso out or exclude any individual members of any such group, including any sub-ranges or combinations of sub-ranges within the group, if for any reason Applicants choose to claim less than the full measure of the disclosure, for example, to account for a reference that Applicants are unaware of at the time of the filing of the application.

In any application before the United States Patent and Trademark Office, the Abstract of this application is provided for the purpose of satisfying the requirements of 37 C.F.R. §1.72 and the purpose stated in 37 C.F.R. §1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

The present disclosure is further illustrated by the following examples, which are not to be construed in any way as imposing limitations upon the scope thereof. The examples are set forth to illustrate the disclosed subject matter and are not intended to be inclusive of all aspects of the subject matter disclosed herein, but rather to illustrate representative methods and results. These examples do not intended to exclude equivalents and variations of the present invention which are apparent to one skilled in the art.

EXAMPLES

The following examples are provided to illustrate various embodiments of the disclosure and the claims. Unless otherwise specified, reagents were obtained from commercial sources. The following analytical methods were used to characterize the resins, and the starting materials and materials below Wet Mullen. Wet mullen strength was determined using a method that is modified from a standard TAPPI Test Method T 807, entitled, "Bursting strength of paperboard and linerboard". Generally, a sample specimen of paperboard and linerboard is clamped between two platens with a circular opening in each of their centers. An expansible diaphragm is then distended through the lower platen by means of hydraulic pressure until the specimen bursts.

Wet Strength (WS) Resins. A wide range of wet strength products can be used to improve the wet strength of paperboard and linerboard according to this disclosure. For example, a range of cationic polyamide wet strength products can be employed, including aqueous solutions with a range of solids from 12.5% to 25%. In the following examples, some of the Amres® Wet Strength Products were used, including Amres® 1110-E, although many other wet strength resins can be employed such as other Amres® products.

Surfactants. Any surfactant can be employed according to this disclosure to improve the wet strength of paper, paperboard and linerboard, and the surfactant can be used as part of the aqueous composition used to pretreat the paper, paperboard and linerboard and/or as an additional component of the wet strength resin composition. For example, a surfactant can be selected independently from a nonionic surfactant, an anionic surfactant, a cationic surfactant, an amphoteric surfactant, or combinations thereof. Aspects of the disclosure are demonstrated using nonionic surfactants, such as Triton® X-100, which is polyethylene glycol p-(1,1,3,3-tetramethylbutyl)-phenyl ether. This nonionic surfactant includes a hydrophilic polyethylene oxide chain (on average about 9.5 ethylene oxide units) and an aromatic hydrocarbon lipophilic or hydrophobic group. Aspects of this disclosure are also demonstrated using the Surfynol® series of nonionic surfactants from Air Products and Chemicals. Surfynol® 420, which is a polyethyleneoxylated acetylenic diol surfactant, was particularly used to collect the data presented in this disclosure.

Application of Coatings. Both #0 and #8 rods were used to apply coatings of wet strength resin and the combination of wet strength resin and surfactant, with the smooth #0 rod metering less solution than the #8 grooved rod. See data reported in Table 2.

Example 1

Preparation of Samples for Comparative Testing

A series of comparative and test samples were used to examine the wet strength treated paperboard prepared according to this disclosure, and these samples are set out in Table 1. All of the Table 1 samples were absent the traditional wet end application in order to determine which of the test coating and process could approach the wet strength properties derived from the traditional wet end application of a wet strength resin.

TABLE 1 amples used for comparative testing.

| Sample | Substrate | Coating | Application | Rod(s) |
|---|---|---|---|---|
| 1 | Unbleached | Amres ® 1110-E | Single | #0, #8 |
| 2 | Unbleached | Amres ® 1110-E + 0.1% Surfynol ® 420 | Single | #0, #8 |
| 3 | Unbleached | Water | Double | #0 |
| | | Amres ® 1110-E | | #8 |
| 4 | Unbleached | Water | Double | #0 |
| | | Amres ® 1110-E + 0.1% Surfynol ® 420 | | #8 |
| 5 | Unbleached | Water + 0.1% Surfynol ® 420 | Double | #0 |
| | | Amres ® 1110-E | | #8 |
| 6 | Unbleached | Water + 0.1% Surfynol ® 420 | Double | #0 |
| | | Amres ® 1110-E + 0.1% Surfynol ® 420 | | #8 |

Samples 1 and 2 were not pretreated with water or an aqueous composition prior to the application of the Amres® 1110-E wet strength resin, both without surfactant (Sample 1) and with surfactant (Sample 2). Samples 3 through 6 were prepared using a water (Samples 3 and 4) or aqueous surfactant solution (Samples 5 and 6) pretreatment to the Samples 1 and 2 materials. That is, water or aqueous surfactant were used to pretreat the paperboard, which were then coated with a wet strength resin, both with and without surfactant.

In addition, both untreated paperboard (Sample C1) and standard wet strength treated paperboard in which a wet strength resin was applied at the wet end in the conventional manner (Sample C2) were tested, with the standard wet strength paperboard constituting the standard of performance against which the other samples are compared.

Example 2

Wet Strength Tests of Samples without Pretreatment

Wet mullen strength was determined using the modified testing procedure described herein. Paperboard samples prepared according to Table 2 were initially soaked in a 0.1% solution of Triton® X-100 for 3 minutes after vacuum was applied, in order to completely saturate the samples. Samples were subsequently cured at 121° C. (250° F.) for 15 minutes to simulate full curing of the wet strength resin. Wet mullen results are provided in Table 2.

Using the modified wet mullen test on untreated paperboard (Sample C1) and standard wet strength treated paperboard in which the wet strength resin was applied at the wet end in the conventional manner (Sample C2), the wet mullen of the standard wet strength paperboard was measured at 28.8 $lb_f$, some four (4) times that of the untreated paperboard. This value of 28.8 $lb_f$ was set as the standard (100%), and wet strength measurements of other samples were reported in absolute ($lb_f$) and relative (% of standard) values.

TABLE 2

Wet mullen test results for samples without pretreatment.

| Sample | Coating | Application | Rod(s) | Wet Mullen $lb_f$ | Percent (%) of Standard |
|---|---|---|---|---|---|
| C1 | Untreated Paperboard | None | None | 7.2 | 25 |
| C2 | Standard Wet Strength Paperboard | None | None | 28.8 | 100 |
| 1 | Amres ® 1110-E | Single | #0 | 9.5 | 33 |
| 1 | Amres ® 1110-E | Single | #8 | 7.5 | 26 |
| 2 | Amres ® 1110-E + 0.1% Surfynol ® 420 | Single | #0 | 8.2 | 28 |
| 2 | Amres ® 1110-E + 0.1% Surfynol ® 420 | Single | #8 | 11.0 | 38 |

As demonstrated in the Table 2 data, two tests each were conducted using Samples 1 and 2, which were not pretreated with water or an aqueous composition, prior to the application of the wet strength resin only (Sample 1) or wet strength resin with surfactant (Sample 2), with the #0 smooth rod metering less solution than the #8 grooved rod. In each test, the measured wet strength was substantially less than that of the standard wet strength paperboard. Comparing the two Sample 1 tests, it is seen that metering more Amres® 1110-E did not improve wet strength performance of the paperboard. Using a surfactant along with the Amres® 1110-E in Sample 2 tests, there was an improvement in performance when more wet strength resin with surfactant was metered. However, none of the Sample 1 or 2 tests approached the wet mullen of the conventional or standard wet strength treated paperboard (Sample C2). On average, the Sample 1 and 2 tests were only about one-third as strong as the wet strength standard, with the best data (38% of standard) observed from applying larger amounts of surfactant along with the wet strength resin.

Example 3

Wet Strength Tests of Samples Pretreated with Water or Aqueous Surfactant

Using same the modified wet mullen test procedure described herein, the wet strength of samples pretreated with water or aqueous surfactant solution was examined and compared to the standard wet strength treated paperboard with conventional wet end treatment (Sample C2). Paperboard samples prepared according to Table 3 were initially soaked in a 0.1% solution of Triton® X-100 for 3 minutes after vacuum was applied, in order to completely saturate the samples. Samples were subsequently cured at 121° C. (250° F.) for 15 minutes to simulate full curing of the wet strength resin. Wet mullen results are provided in Table 3.

TABLE 3

Wet mullen test results for samples with pretreatment.

| Sample | Coating | Application | Rod(s) | Wet Mullen, $lb_f$ | Percent (%) of Standard |
|---|---|---|---|---|---|
| C1 | Untreated Paperboard | None | None | 7.2 | 25 |
| C2 | Standard Wet Strength Paperboard | None | None | 28.8 | 100 |
| 3 | Water | Double | #0 | 16.0 | 56 |
| | Amres ® 1110-E | | #8 | | |
| 4 | Water | Double | #0 | 17.2 | 60 |
| | Amres ® 1110-E + 0.1% Surfynol ® 420 | | #8 | | |

TABLE 3-continued

Wet mullen test results for samples with pretreatment.

| Sample | Coating | Application | Rod(s) | Wet Mullen, $lb_f$ | Percent (%) of Standard |
|---|---|---|---|---|---|
| 5 | Water + 0.1% Surfynol ® 420 | Double | #0 | 17.6 | 61 |
| | Amres ® 1110-E | | #8 | | |
| 6 | Water + 0.1% Surfynol ® 420 | Double | #0 | 19.2 | 67 |
| | Amres ® 1110-E + 0.1% Surfynol ® 420 | | #8 | | |

Samples 3 and 4 used water as a pretreatment, followed by wet strength resin only (Sample 3) or wet strength resin plus surfactant (Sample 4). Samples 5 and 6 used aqueous surfactant solution as a pretreatment, followed by wet strength resin only (Sample 5) or wet strength resin plus surfactant (Sample 6). The results for all samples show a striking improvement over the comparable sample with no water or aqueous composition pretreatment.

Comparing the data for Samples 3-6, it is observed that in each case the aqueous surfactant solution pretreatment provided somewhat improved results as compared to water only pretreatment. In each case, the use of wet strength resin plus surfactant also gave improved results as compared to wet strength resin coating only. In dramatic contrast to the samples with no pretreatment, the Samples 3-6 tests averaged about 61% of the wet mullen of the standard wet strength treated paperboard (Table 3), representing a near 100% improvement over the samples with no pretreatment (Table 2). Moreover, the best results were obtained using surfactant in both aqueous composition pretreatment and in wet strength resin coating composition, which has a wet mullen of two-thirds that of the standard wet strength treated paperboard.

It should be understood that the foregoing relates to particular aspects or embodiments of the present disclosure and that numerous changes and adjustments may be made therein without departing from the scope of the invention as defined from the following claims.

The following clauses set out features of the invention which may not presently be claimed, but which may form the basis for amendments or future continuing applications.

1. A process for improving the wet strength of paper or paperboard, comprising:
   a) providing a paper or paperboard having a first side and a second side;
   b) contacting at least one of the first side and the second side with water or an aqueous composition for a first time period to provide a wet paper or paperboard;
   c) contacting the wet paper or paperboard with a wet strength resin composition for a second time period to provide a treated paper or paperboard; and
   d) drying the treated paper or paperboard.

2. A process according to clause 1, wherein the aqueous composition, the wet strength resin composition, or both compositions comprise(s) a surfactant.

3. A process according to any preceding clause, wherein the aqueous composition, the wet strength resin composition, or both compositions comprise(s) a surfactant selected independently from a nonionic surfactant, an anionic surfactant, a cationic surfactant, or an amphoteric surfactant.

4. A process according to any preceding clause, wherein the aqueous composition, the wet strength resin composition, or both compositions comprise(s) a surfactant selected independently from a polyoxyalkylene, an adduct of an alkylene oxide and an alcohol, an alkyl polyglucoside, a fatty alcohol, a hydrocarbylsulfonate, a sulfate ester, a phosphate ester, a quaternary ammonium compound, a betaine compound, an aminohydrocarbyl sulfonate, a silicone-based surfactant, a phenol, a mercaptan, a carboxylic acid, and any combination thereof.

5. A process according to any preceding clause, wherein the aqueous composition, the wet strength resin composition, or both compositions comprise(s) a surfactant selected independently from a polyethylene glycol, a polypropylene glycol, a polyoxyethylene glycol alkyl ether, a polyoxypropylene glycol alkyl ether, a glucoside alkyl ether, a polyoxyethylene glycol alkylphenol ether, a glycerol alkyl ester, a polysorbate, a polyethoxylated tallow amine, a polyol, an acetylenic diol, an ethoxylated acetylenic diol, an ethoxylated amine, an ether amine, an amine oxide, and any combination thereof.

6. A process according to any preceding clause, wherein the aqueous composition, the wet strength resin composition, or both compositions comprise(s) a surfactant selected independently from saponified fatty acids, alkyl sulfonates, aryl sulfonates, alkyl(aryl)sulfonates, alkylether sulfates, sulfate esters, phosphate esters, alkyl phosphates, dialkyl phosphates, aryl phosphates, diaryl phosphates, alkyl(aryl) phosphates, alkylphosphonate, arylphosphonate, alkyl(aryl) phosphonates, aminoalkyl phosphonic acid, mono-ethanolamine, di-ethanolamine, tri-ethanolamine, and any combination thereof.

7. A process according to any preceding clause, wherein the aqueous composition, the wet strength resin composition, or both compositions comprise(s) a surfactant selected independently from a primary amine, a secondary amine, a tertiary amine, a quaternary ammonium compound, a tetraalkyl ammonium compound, an alkyltrimethyl ammonium compound, an alkyl pyridinium compound, a benzalkonium compound, a benzethonium compound, tertiary ammonium compound, a quaternary ester ammonium salt, and any combination thereof.

8. A process according to any preceding clause, wherein the aqueous composition, the wet strength resin composition, or both compositions comprise(s) a surfactant selected independently from an alkylbetaine, an alkylamidopropylbetaine, an arylamidopropylbetaine, an aminoalkylsulfonate, an aminoarylsulfonate, an aminoalkyl(aryl)sulfonates, an amino alkylether sulfates, an amidoalkyl hydroxyl sultaine, a lecithin and any combination thereof.

9. A process according to any preceding clause, wherein the aqueous composition, the wet strength resin composition, or both compositions comprise(s) from 0.01% to 10% by weight surfactant.

10. A process according to any preceding clause, wherein the aqueous composition, the wet strength resin composition, or both compositions comprise(s) Triton® X-100 or Surfynol® 420.

11. A process according to any preceding clause, wherein the aqueous composition, the wet strength resin composition, or both compositions comprise(s) at least one additional component selected from a colorant, a pigment, a dye, a sizing composition, a starch, a latex, a fluorochemical, a guar gum, a polyacrylamide, a carboxymethyl cellulose, and a combination thereof.

12. A process according to any preceding clause, wherein the wet strength resin composition comprises an aliphatic aldehyde, an aromatic aldehyde, a urea-formaldehyde resin, a melamine formaldehyde resin, or a polyamide-epihalohydrin resin.

13. A process according to any preceding clause, wherein the wet strength resin composition comprises an epihalohydrin-modified polyamine, polyamidoamine, polyethyleneimine (PEI), polyvinyl amine, or a combination thereof.

14. A process according to any preceding clause, wherein the wet strength resin composition comprises an epihalohydrin-modified polyamine, and the polyamine has the structure:

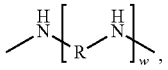

wherein R is alkyl, hydroxyalkyl, amide, aryl, heteroaryl, cycloalkyl, or poly-primary amine, and w is an integer from 1 to about 10,000.

15. A process according to clause 14, wherein the polyamine has molecular weight of about 2,000 to about 1,000,000.

16. A process according to clause 14-15, wherein the polyamine is reacted with a mono-functional modifier prior to, during, or after treating with the epihalohydrin.

17. The process according to clause 16, wherein the mono-functional modifier is selected from a neutral or cationic acrylate compound, a neutral or cationic acrylamide compound, an acrylonitrile compound, a mono-epoxide compound, and a combination thereof.

18. A process according to one of clauses 12-17, wherein the epihalohydrin is selected from epichlorohydrin, epibromohydrin, and epiiodohydrin.

19. A process according to any preceding clause, wherein the wet strength resin composition comprises an epihalohydrin-modified polyamine wet strength resin selected from polyaminoamide-epihalohydrin resins, polyamide-polyamine-epihalohydrin resins, polyaminepolyamide-epihalohydrin resins, aminopolyamide-epihalohydrin resins, polyamide-epihalohydrin resins polyalkylene polyamine-epihalohydrin resins, polyaminourylene-epihalohydrin resins, copolyamide-polyurylene-epichlorohydrin resins, and polyamide-polyurylene-epichlorohydrin resins.

20. A process according to any preceding clause, wherein the wet strength resin composition comprises a polyamidoamine-epichlorohydrin resin, a polyamine-epichlorohydrin resin, or a combination thereof.

21. A process according to any preceding clause, wherein the wet mullen of the treated paper or paperboard is from 1.5 to 3.5 times greater than the wet mullen of the paper or paperboard prior to treating.

22. A process according to any preceding clause, wherein a pH of the wet strength resin composition is adjusted to about pH 2.0 to about pH 4.5 prior to contacting the wet paper or paperboard with the wet strength resin composition.

23. A process according to any preceding clause, wherein the solids content of the wet strength resin composition is adjusted to have from about 10% to about 50% solids content.

24. A process according to any preceding clause, wherein the wet strength resin composition has a charge density from about 1.0 to about 4.0 mEq/g of solids.

25. A process according to any preceding clause, wherein the paper or paperboard is previously untreated with a wet strength resin at the process wet end.

26. A process according to any preceding clause, wherein the paper or paperboard is previously treated with a wet strength resin at the process wet end.

27. A process according to any preceding clause, wherein steps b and c are carried out on the first side of the paper or paperboard, and subsequently repeated on the second side of the paper or paperboard.

28. Paper or paperboard having improved wet strength, the paper or paperboard prepared by the method of any preceding clause.

29. Paper or paperboard having improved wet strength comprising a treated fibrous web, the treated fibrous web comprising:

a) cellulose fibers, a portion of which having intact inter-fiber hydrogen bonding and a portion of which having inter-fiber hydrogen bonding at least partially disrupted with water or an aqueous composition;

b) a wet strength resin composition in contact with the cellulose fibers having partially disrupted inter-fiber hydrogen bonding.

30. Paper or paperboard according to clause 29, wherein the aqueous composition, the wet strength resin composition, or both compositions comprise(s) a surfactant.

31. Paper or paperboard according to clause 29-30, wherein the aqueous composition, the wet strength resin composition, or both compositions comprise(s) a surfactant selected independently from a nonionic surfactant, an anionic surfactant, a cationic surfactant, or an amphoteric surfactant.

32. Paper or paperboard according to clause 29-31, wherein the aqueous composition, the wet strength resin composition, or both compositions comprise(s) from 0.01% to 10% by weight surfactant.

33. Paper or paperboard according to clause 29-32, wherein the aqueous composition, the wet strength resin composition, or both compositions comprise(s) Triton® X-100 or Surfynol® 420.

34. Paper or paperboard according to clause 29-33, wherein the wet strength resin composition comprises an aliphatic aldehyde, an aromatic aldehyde, a urea-formaldehyde resin, a melamine formaldehyde resin, or a polyamide-epihalohydrin resin.

35. Paper or paperboard according to clause 29-34, wherein the wet strength resin composition comprises an epihalohydrin-modified polyamine, polyamidoamine, polyethyleneimine (PEI), polyvinyl amine, or a combination thereof.

36. Paper or paperboard according to clause 29-35, wherein the wet strength resin composition comprises an epihalohydrin-modified polyamine, and the polyamine has the structure:

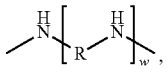

wherein R is alkyl, hydroxyalkyl, amide, aryl, heteroaryl, cycloalkyl, or poly-primary amine, and w is an integer from 1 to about 10,000.

37. Paper or paperboard according to clause 36, wherein the polyamine is reacted with a mono-functional modifier prior to, during, or after treating with the epihalohydrin.

38. Paper or paperboard according to clause 37, wherein the mono-functional modifier is selected from a neutral or cationic acrylate compound, a neutral or cationic acrylamide compound, an acrylonitrile compound, a mono-epoxide compound, and a combination thereof.

39. Paper or paperboard according to clause 29, wherein the wet strength resin composition comprises an epihalohydrin-modified polyamine wet strength resin selected from polyaminoamide-epihalohydrin resins, polyamide-polyamine-epihalohydrin resins, polyaminepolyamide-epihalohydrin resins, aminopolyamide-epihalohydrin resins, polyamide-epihalohydrin resins polyalkylene polyamine-epihalohydrin resins, polyaminourylene-epihalohydrin resins, copolyamide-polyurylene-epichlorohydrin resins, and polyamide-polyurylene-epichlorohydrin resins.

40. Paper or paperboard according to clause 29,wherein the wet strength resin composition comprises a polyamidoamine-epichlorohydrin resin, a polyamine-epichlorohydrin resin, or a combination thereof.

We claim:

1. A process for improving the wet strength of paper or paperboard, comprising:

contacting at least one of a first side and a second side of a paper or a paperboard with water or an aqueous composition for a first time period to provide a wet paper or a wet paperboard, wherein the first time period is from 0.02 seconds to about 48 hours;

contacting the wet paper or the wet paperboard with a wet strength resin composition for a second time period to provide a treated paper or a treated paperboard, wherein the second time period occurs after the first time period; and drying the treated paper or the treated paperboard.

2. The process according to claim 1, wherein the aqueous composition, the wet strength resin composition, or both the aqueous composition and the wet strength resin composition comprise a surfactant selected independently from a non-ionic surfactant, an anionic surfactant, a cationic surfactant, and an amphoteric surfactant.

3. The process according to claim 1, wherein the aqueous composition, the wet strength resin composition, or both the aqueous composition and the wet strength resin composition comprise a surfactant selected independently from a polyoxyalkylene, an adduct of an alkylene oxide and an alcohol, an alkyl polyglucoside, a fatty alcohol, a hydrocarbylsulfonate, a sulfate ester, a phosphate ester, a quaternary ammonium compound, a betaine compound, an aminohydrocarbyl sulfonate, a silicone-based surfactant, a phenol, a mercaptan, a carboxylic acid, and any combination thereof.

4. The process according to claim 1, wherein the aqueous composition, the wet strength resin composition, or both the aqueous composition and the wet strength resin composition comprise a surfactant selected independently from:

a) a polyethylene glycol, a polypropylene glycol, a polyoxyethylene glycol alkyl ether, a polyoxypropylene glycol alkyl ether, a glucoside alkyl ether, a polyoxyethylene glycol alkylphenol ether, a glycerol alkyl ester, a polysorbate, a polyethoxylated tallow amine, a polyol, an acetylenic diol, an ethoxylated acetylenic diol, an ethoxylated amine, an ether amine, an amine oxide, and any combination thereof;

b) saponified fatty acids, alkylsulfonates, arylsulfonates, alkyl(aryl)sulfonates, alkylether sulfates, sulfate esters, phosphate esters, alkyl phosphates, dialkyl phosphates, aryl phosphates, diaryl phosphates, alkyl(aryl)phosphates, an alkylphosphonate, an arylphosphonate, an alkyl(aryl)phosphonates, an aminoalkyl phosphonic acid, mono-ethanolamine, di-ethanolamine, tri-ethanolamine, and any combination thereof;

c) a primary amine, a secondary amine, a tertiary amine, a quaternary ammonium compound, a tetraalkyl ammonium compound, an alkyltrimethyl ammonium compound, an alkyl pyridinium compound, a benzalkonium compound, a benzethonium compound, a tertiary ammonium compound, a quaternary ester ammonium salt, and any combination thereof; and d) an alkylbetaine, an alkylamidopropylbetaine, an arylamidopropylbetaine, an aminoalkylsulfonate, an aminoarylsulfonate, an aminoalkyl(aryl)sulfonates, an amino alkylether sulfates, an amidoalkyl hydroxyl sultaine, a lecithin, and any combination thereof.

5. The process according to claim 1, wherein the aqueous composition, the wet strength resin composition, or both the aqueous composition and the wet strength resin composition comprise at least one additional component selected independently from a colorant, a pigment, a dye, a sizing composition, a starch, a latex, a fluorochemical, a guar gum, a polyacrylamide, a carboxymethyl cellulose, and a combination thereof.

6. The process according to claim 1, wherein the wet strength resin composition comprises a polyamidoamine-epichlorohydrin resin having a solids content of about 10 wt % to about 30 wt % and a pH of about 2 to about 4.5.

7. The process according to claim 1, wherein the wet strength resin composition comprises an epihalohydrin-modified polyamine, and the polyamine has the structure:

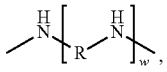

wherein R is an alkyl, a hydroxyalkyl, an amide, an aryl, a heteroaryl, a cycloalkyl, or a poly-primary amine, and w is an integer from 1 to about 10,000, and wherein the polyamine has a weight average molecular weight of about 2,000 to about 1,000,000.

8. The process according to claim 7, wherein the polyamine is reacted with a mono-functional modifier selected from a neutral or cationic acrylate compound, a neutral or cationic acrylamide compound, an acrylonitrile compound, a mono-epoxide compound, and a combination thereof.

9. The process according to claim 1, wherein the wet strength resin composition comprises:

a) an epihalohydrin-modified polyamine wet strength resin selected from polyaminoamide-epihalohydrin resins, polyamidepolyamine-epihalohydrin resins, polyaminepolyamide-epihalohydrin resins, aminopolyamide-epihalohydrin resins, polyamide-epihalohydrin resins polyalkylene polyamine-epihalohydrin resins, polyaminourylene-epihalohydrin resins, copolyamide-polyurylene-epichlorohydrin resins, and polyamide-polyurylene-epichlorohydrin resins; or b) a polyamidoamine-epichlorohydrin resin, a polyamine-epichlorohydrin resin, or a combination thereof.

10. The process according to claim 1, wherein:

a) a wet mullen of the treated paper or the treated paperboard is from 1.5 to 3.5 times greater than a wet mullen of the paper or the paperboard prior to contacting the wet paper or the wet paperboard with the wet strength resin composition;

b) a pH of the wet strength resin composition is about 2.0 to about 4.5 prior to contacting the wet paper or the wet paperboard with the wet strength resin composition;

c) the wet strength resin composition has a solids content of about 10 wt % to about 50 wt %; or d) the wet strength resin composition has a charge density of about 1.0 mEq/g of solids to about 4.0 mEq/g of solids.

11. The process according to claim 1, wherein the first time period is from about 1 minute to about 48 hours.

12. The process according to claim 1, wherein the first time period is from 0.03 seconds to about 60 seconds.

13. The process according to claim 1, wherein:

the at least one of the first side and the second side of the paper or the paperboard is contacted with the aqueous composition for the first time period to provide the wet paper or the wet paperboard, the aqueous composition comprises a polyethyleneoxylated acetylenic diol surfactant, and the wet strength resin composition comprises a polyamidoamine-epichlorohydrin resin having a solids content of about 10 wt % to about 30 wt % and a pH of about 2 to about 4.5.

14. A paper or a paperboard having improved wet strength comprising a treated fibrous web, the treated fibrous web comprising:

cellulose fibers, wherein a first portion of the cellulose fibers have intact inter-fiber hydrogen bonding and a second portion of the cellulose fibers have inter-fiber hydrogen bonding at least partially disrupted with water or an aqueous composition contacted therewith; and a wet strength resin composition in contact with the second portion of the cellulose fibers that have inter-fiber hydrogen bonding at least partially disrupted with the water or the aqueous composition, wherein the water or the aqueous composition is contacted with the second portion of the cellulose fibers 0.02 seconds to about 48 hours before the wet strength resin composition is contacted with the second portion of the cellulose fibers.

15. The paper or the paperboard according to claim 14, wherein the aqueous composition, the wet strength resin composition, or both the aqueous composition and the wet strength resin composition comprise a surfactant selected independently from a nonionic surfactant, an anionic surfactant, a cationic surfactant, and an amphoteric surfactant.

16. The paper or the paperboard according to claim 14, wherein the wet strength resin composition comprises a polyamidoamine-epichlorohydrin resin having a solids content of about 10 wt % to about 30 wt % and a pH of about 2 to about 4.5.

17. The paper or the paperboard according to claim 14, wherein the wet strength resin composition comprises an epihalohydrin-modified polyamine, and the polyamine has the structure:

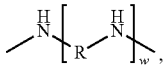

wherein R is an alkyl, a hydroxyalkyl, an amide, an aryl, a heteroaryl, a cycloalkyl, or a poly-primary amine, and w is an integer from 1 to about 10,000.

18. The paper or the paperboard according to claim 14, wherein the wet strength resin composition comprises:

a) an epihalohydrin-modified polyamine wet strength resin selected from polyaminoamide-epihalohydrin resins, polyamidepolyamine-epihalohydrin resins, polyaminepolyamide-epihalohydrin resins, aminopolyamide-epihalohydrin resins, polyamide-epihalohydrin resins polyalkylene polyamine-epihalohydrin resins, polyaminourylene-epihalohydrin resins, copolyamide-polyurylene-epichlorohydrin resins, and polyamide-polyurylene-epichlorohydrin resins; or b) a polyamidoamine-epichlorohydrin resin, a polyamine-epichlorohydrin resin, or a combination thereof.

19. A process for improving the wet strength of paper or paperboard, comprising:

contacting at least a first side of a paper or a paperboard with water or an aqueous composition comprising a surfactant for a first time period to provide a wet paper or a wet paperboard, wherein the first time period is from 0.02 seconds to about 48 hours;

contacting the wet paper or the wet paperboard with a wet strength resin composition for a second time period to provide a treated paper or a treated paperboard, wherein the second time period occurs after the first time period, and wherein the wet strength resin composition comprises a polyamidoamine-epichlorohydrin resin having a solids content of about 10 wt % to about 30 wt % and a pH of about 2 to about 4.5;

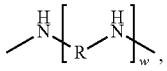

drying the treated paper or the treated paperboard.

20. The process of claim 19, wherein the first side of the paper or the paperboard is contacted with the aqueous composition comprising the surfactant, and wherein the surfactant comprises a polyethyleneoxylated acetylenic diol surfactant.

* * * * *